US008100308B2

(12) United States Patent
Aquarius

(10) Patent No.: US 8,100,308 B2
(45) Date of Patent: Jan. 24, 2012

(54) APPARATUS FOR SEPARATING INTERCONNECTED CUSHIONS, AND ASSEMBLY OF SUCH AN APPARATUS AND AN APPARATUS FOR MANUFACTURING INTERCONNECTED CUSHIONS

(75) Inventor: Pieter Theodorus Joseph Aquarius, Stramproy (NL)

(73) Assignee: Ideepak Holding B.V., Stramproy (NL)

( * ) Notice: Subject to any disclaimer, the term of this patent is extended or adjusted under 35 U.S.C. 154(b) by 299 days.

(21) Appl. No.: 11/772,298

(22) Filed: Jul. 2, 2007

(65) Prior Publication Data

US 2008/0093407 A1 Apr. 24, 2008

(30) Foreign Application Priority Data

Jun. 30, 2006 (NL) ..... 1032097

(51) Int. Cl.

| | |
|---|---|
| ***B26F 3/00*** | (2006.01) |
| ***B65H 35/00*** | (2006.01) |
| ***B65B 31/00*** | (2006.01) |
| ***B65D 81/18*** | (2006.01) |
| ***B31B 1/00*** | (2006.01) |

(52) U.S. Cl. ..... 225/100; 53/79; 493/28

(58) Field of Classification Search ..... 225/100; 53/79, 403; 493/28, 372

See application file for complete search history.

(56) References Cited

U.S. PATENT DOCUMENTS

| | | | | |
|---|---|---|---|---|
| 3,675,542 | A * | 7/1972 | Torigoe | 493/194 |
| 3,938,298 | A * | 2/1976 | Luhman et al. | 53/403 |
| 4,498,894 | A * | 2/1985 | Kuckhermann | 493/234 |
| 5,064,408 | A * | 11/1991 | Bridgeman | 493/194 |
| 5,480,083 | A * | 1/1996 | Achelpohl | 225/100 |
| 5,552,003 | A * | 9/1996 | Hoover et al. | 156/147 |
| 5,755,082 | A * | 5/1998 | Takahashi et al. | 53/511 |
| 7,571,589 | B2 * | 8/2009 | Shaw et al. | 53/403 |

FOREIGN PATENT DOCUMENTS

| | | |
|---|---|---|
| DE | 43 02 567 C1 | 3/1994 |
| EP | 1 563 987 A1 | 8/2005 |
| WO | WO 2006/019773 A1 | 2/2006 |

OTHER PUBLICATIONS

European Search Report for EP 07 11 1483 dated Oct. 16, 2007.

* cited by examiner

*Primary Examiner* — Ghassem Alie
*Assistant Examiner* — Bharat C Patel
(74) *Attorney, Agent, or Firm* — Leydig, Voit & Mayer, Ltd.

(57) ABSTRACT

A separating apparatus is described for separating interconnected cushions by breaking weakening lines provided between these cushions. To this end, the apparatus includes at least one circulating element and a conveyor for carrying the interconnected cushions along the circulating element. The circulating element is arranged for engaging the interconnected cushions at least once during a circulating movement of the circulating element, in order to carry one of these cushions along over a part of the circulating movement at a carrying speed which is higher than a conveying speed of the conveyor. An apparatus is described for manufacturing cushions by filling chambers formed in film material with a gas and then sealing them.

14 Claims, 6 Drawing Sheets

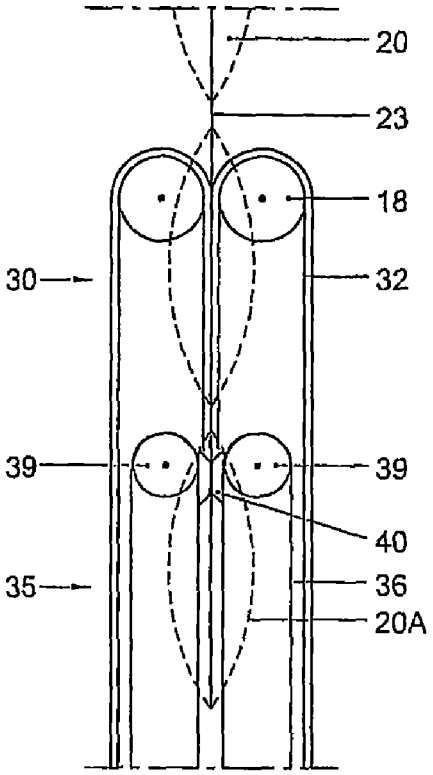
Fig. 4A
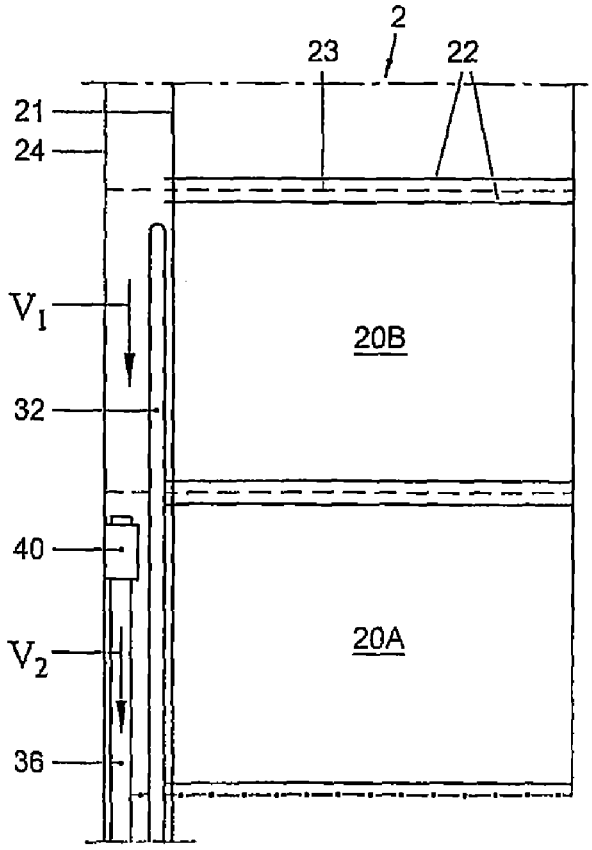
Fig. 4B
Fig. 4C
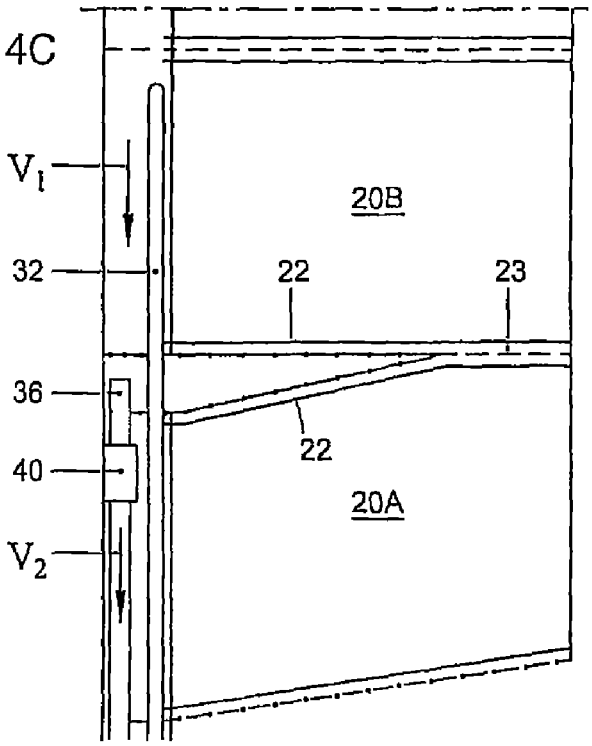

APPARATUS FOR SEPARATING INTERCONNECTED CUSHIONS, AND ASSEMBLY OF SUCH AN APPARATUS AND AN APPARATUS FOR MANUFACTURING INTERCONNECTED CUSHIONS

This application claims priority to Netherlands Patent Application No. 1032097, filed on Jun. 30, 2006.

FIELD OF THE INVENTION

The invention relates to an apparatus for separating interconnected cushions, by breaking weakening lines provided between these cushions.

BACKGROUND

Such cushions may, for instance, be manufactured from tubular film material which is divided into chambers by means of cross sealing seams. These chambers are filled with air or another gas or gas mixture and then closed, for instance by sealing. After this, the cushions are separated from one another by the piece or by string, by breaking weakening lines provided in the film material. The separated cushions may, for instance, be used as filling and/or protective material in packagings.

It is important that the separation of the cushions takes place carefully, in order to prevent them from becoming damaged or springing a leak. In practice, the tearing off is therefore often done manually. This is labor-intensive and therefore undesirable. Further, it is known to separate the cushions mechanically. Here, the edge of the film material is, on both sides of a weakening line to be broken, clamped between two clamping elements, which are then moved apart. Thereby, the weakening line is broken. A drawback of this known apparatus is that the clamping elements need to carry out a relatively complicated movement, in which they are first displaced in the direction of the film material, substantially at right angles to a conveying direction of this film material, are then moved apart, parallel to this conveying direction, and are finally withdrawn again, substantially at right angles to the conveying direction. This requires complex drive means taking up relatively much space.

SUMMARY OF THE INVENTION

The invention contemplates providing an apparatus of the above-described type, where the drawbacks of the known separating apparatus are at least partly obviated. To this end, an apparatus according to the invention is characterized by use of a circulating element having a circulating speed or peripheral speed which is considerably higher than a conveying speed of the interconnected cushions. In this specification, a 'circulating element' is understood to mean an element or element part which is arranged for carrying out a revolution or a circulating movement, such as for instance a belt guided around a number of drive and/or guide rollers or a wheel which can rotate about an axis.

By temporarily bringing such a circulating element into engagement with one of the cushions, the respective cushion will be carried along at a carrying speed which is much higher than the conveying speed of the adjacent cushions. As a result, the weakening line between this cushion and the adjacent cushions will be subject to a tensile force, which causes the line to break.

Temporarily bringing the circulating element into engagement can be done relatively simply, for instance by providing the circulating element with a local thickening or cam. With such a circulating element, one rotary engine is sufficient and complex drive mechanisms can be omitted.

According to an advantageous embodiment, the circulating element may be designed as an endless belt, provided with at least one carrying cam. The conveying means which guide the cushions to the circulating element may also comprise an endless belt. Both belts may be driven by one drive apparatus, in combination with suitable transmission means. Thus, a still simpler arrangement can be obtained. In addition, the endless belts may be arranged in a compact manner, by arranging the endless belt of the circulating element inside the path of travel of the conveyor belt.

The invention further relates to an assembly of a separating apparatus according to the invention and an apparatus preceding it for inflating and sealing chambers formed in film material. Here, both apparatuses are preferably arranged with respect to each other such that their feed-through directions include an angle. This angle may, for instance, be between about 25° and 45°. Thanks to such an angle, the feed-through direction in the assembly adequately matches the natural movement the film material makes during inflation of the chambers. As a result, undesired (tensile) forces on and/or creasing of the film material can be avoided or reduced.

According to a further advantageous aspect of the invention, the separating apparatus, at least a feed-through direction thereof, is operatively oriented substantially vertically. As a result, a very compact arrangement can be obtained, at least an apparatus which takes up little space.

BRIEF DESCRIPTION OF THE DRAWINGS

In the further subclaims, further advantageous embodiments of an apparatus according to the invention are described. By way of explanation of the invention, exemplary embodiments of a separating apparatus according to the invention, and the use thereof, will be elucidated with reference to the drawing, in which:

FIGS. 4A,B show, in more detail, the separating apparatus according to the invention, in front view and side elevational view, respectively, at the moment when the carrying cams engage a cushion to be separated;

FIG. 4C shows, in side elevational view, the separating apparatus according to FIG. 4B, at a slightly later point in time, where the cushion is partly separated;

DETAILED DESCRIPTION OF THE DRAWINGS

Figure 1:
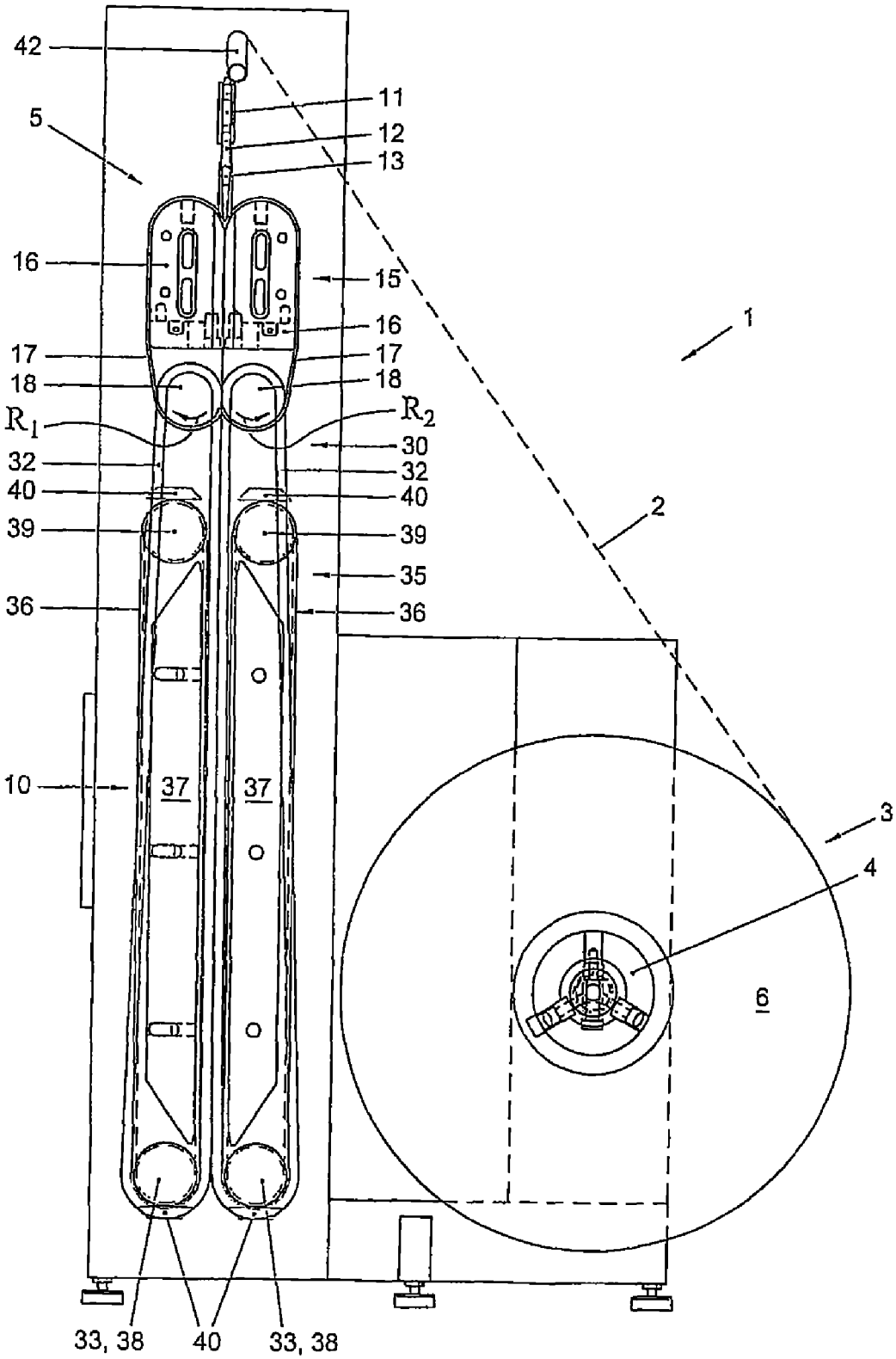
FIG. 1 shows, in front view, an assembly of an apparatus for manufacturing interconnected air cushions, and a separating apparatus according to the invention.
Figure 2:
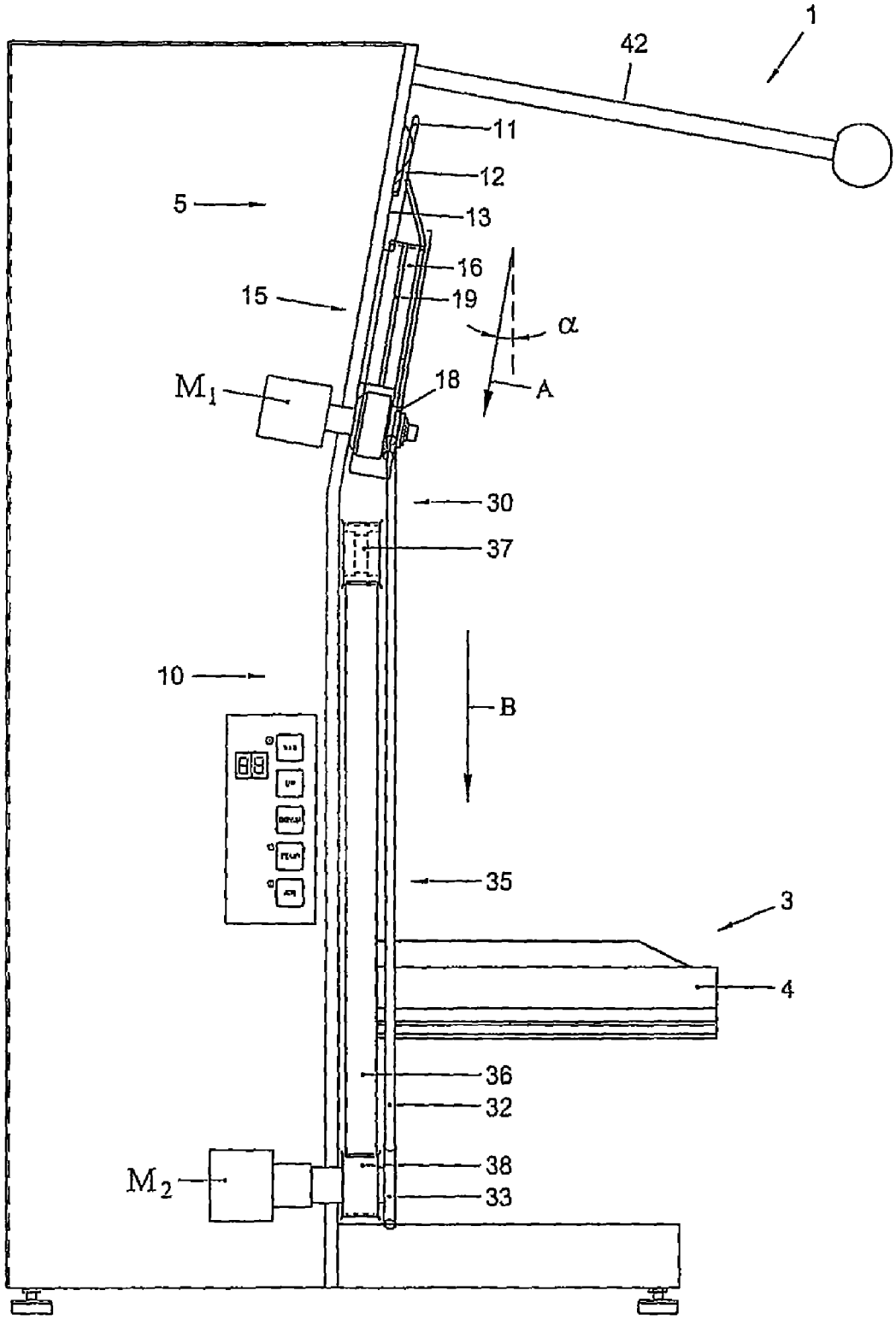
FIG. 2 shows the assembly according to FIG. 1, in side elevational view.
Figure 3:
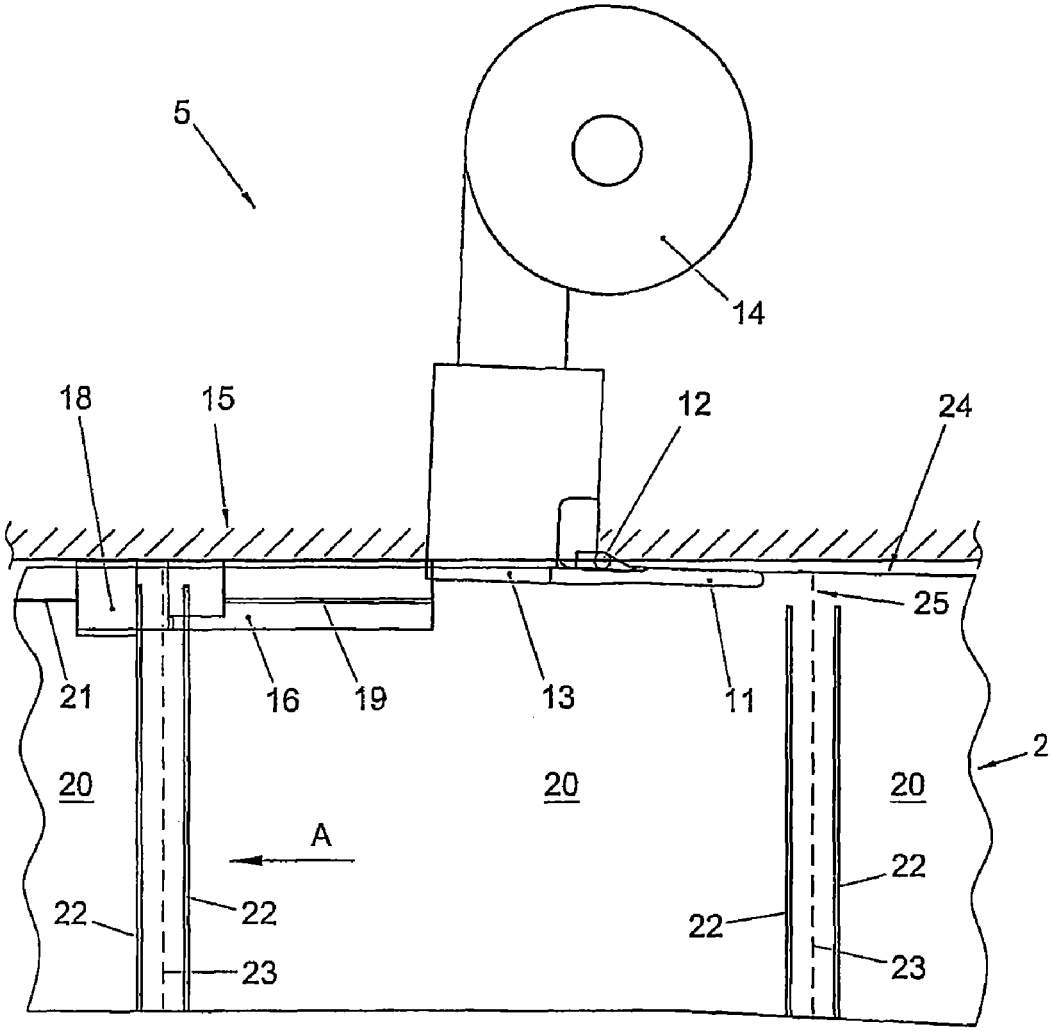
FIG. 3 shows, in top plan view, an example of a specially prepared film material, suitable for use in an assembly according to FIGS. 1 and 2.

FIGS. 1 and 2 show an assembly 1 for manufacturing air cushions from film material 2. This film material 2 may, for instance, be prepared as shown in FIG. 3, where tubular film material is provided with cross sealing seams 22 which divide the film into chambers 20. The cross sealing seams 22 do not extend over the whole width of the film 2, but end at a short distance from one of the longitudinal edges 24, thereby leaving a passage 25 between this longitudinal edge 24 and the cross sealing seams 22. Each cross sealing seam 22 in fact consists of two sealing seams extending substantially parallel at a short distance from each other between which a weakening line 23 is provided, for instance a perforation line. These weakening lines 23 preferably do extend over the whole width of the tube film 2.

The assembly 1 comprises a supply provision 3 for supply of the film material 2, an apparatus 5 for inflating and sealing the cushions and a separating apparatus 10 for separating the cushions 20, by the piece or by string. The assembly 1 further comprises conveying and guide means for guiding the film material 2 along above-mentioned apparatuses.

In the exemplary embodiment shown, the supply provision 3 comprises a spindle 4, suitable for unwinding a roll 6 of film material. Of course, the film material 2 may be supplied in a different manner, for instance in a stacked manner, in which case the supply provision 3 may have a matching shape (not shown).

The apparatus 5 for inflating and sealing the cushions comprises (as can perhaps most clearly be seen in FIG. 3) a rod-shaped guide element 11 which can extend through the passage 25 in the film material 2, a knife 12 with which a longitudinal edge 24 of the film material 2 can be cut open and a blow nozzle 13 and pumping means 14 connected thereto, with which the chambers 20 in the film material 2 can be filled with compressed air or another gaseous medium, for instance nitrogen or helium, via the cut-open longitudinal edge 24. The apparatus 5 further comprises a sealing unit 15, with which the chambers 20 can be sealed with a longitudinal sealing seam 21 directly after filling. To this end, this sealing unit 15 comprises two elongated sealing blocks 16, which are placed against each other by their large sides. At least one of these large sides is provided with a heating element 19, for instance a sealing thread (as shown in FIG. 3). Around each of the blocks 16, a circulating belt 17 may be provided, which is driven in opposite directions (see arrows $R_{1,2}$) by pulleys 18 and first drive means M1. Thus, the circulating belts 17 can carry the film material 2 along, clamped between them, in a conveying direction A. In addition, the circulating belts 17 can protect the film material 2 from direct contact with the heating element 19.

The separating apparatus 10 comprises circulating elements 35 for breaking the weakening lines 23 between cushions 20 to be separated, and conveying means 30 for guiding the film material 2 from the preceding apparatus 5 along these circulating elements 35. To this end, the conveying means 30 may, for instance, comprise two endless cords 32, which are each guided along a guide roller 33 and a drive roller 18, and directly abut each other along a part of their circulating paths. The cords 32 are driven in opposite directions and can thus carry along the film material 2 between them at a conveying speed $v_1$. In order to not unnecessarily load the cushions 20 formed in the film material 2, the cords 32 preferably engage the edge part of the film material 2 between the longitudinal sealing seam 21 and the longitudinal edge 24, as can be seen in FIGS. 4B and 4C.

In the exemplary embodiment shown, the cords 32 are driven by the same pulleys 18 as the circulating belts 17 of the inflating and sealing apparatus 5. This limits the number of parts required and, in addition, ensures that a conveying speed $v_1$ of the cords 32 is equal to that of the circulating belts 17. As a result, the taking over of the film material 2 by the cords 32 can proceed smoothly, without creasing or undesired tensile forces.

In the exemplary embodiment shown, the circulating elements 35 comprise two circulating belts 36, which are each guided around an elongated guide block 37 and two guide rollers 38, 39, arranged near opposite ends of the guide block 37. In the exemplary embodiment shown, the circulating belts 36 are driven by the lower guide rollers 38 and second drive means M2 engaging them. The drive is such that the belts 36 are driven in opposite directions, at a speed V2 which is considerably higher than the speed $v_1$ of the conveying means 30. The afore-described guide roller 33 of the conveying cords 32 may, as shown, be bearing-mounted on the drive shaft of the second drive means M2 via clearance means suitable for this purpose.

Each belt 36 is provided with two carrying cams 40, which can temporarily come into engagement with each other and the film material during circulation of the belts 36, and can thus carry along this film material. Here, the mutual distance between the guide blocks 37 is set such that the carrying cams 40 between these blocks 37 are pressed against each other, so that the film material 2 can be clamped tightly. In order to be able to accurately gear this mutual distance between the guide blocks 37 to the thickness of the carrying cams 40 and the film material 2, at least one of these guide blocks 37 is preferably adjustably suspended (as shown in FIG. 1 for the left guide block 37).

The afore-described assembly operates as follows. The tubular film material 2 is slid over the guide element 11 by opening 25, after which longitudinal edge 24 is cut open by knife 12. Then the chambers 20 are filled with air via the just cut-open longitudinal edge 24 with the aid of the blow nozzle 13. As a result, the chambers 20 will bulge slightly as shown in broken lines in FIG. 4A. The chambers 20 are then sealed between the sealing blocks 16 of the sealing unit 15, with the formed longitudinal sealing seam 21 crossing the cross sealing seams 22. Thus, a chain of air cushions 20 is obtained. This chain is then fed between the cords 32 to the circulating elements 35 of the separating apparatus 10. FIGS. 4A and 4B show, in front view and side elevational view, respectively, the moment when the carrying cams 40 engage a longitudinal edge of a cushion 20A to be separated. Because the conveying speed $v_2$ of the carrying cams 40 is much higher than the conveying speed $v_1$ of the cords 32, a tensile force will be exerted on the weakening line 23 so that it will be broken on the side of the cams 40. With the cams 40 moving further, the cushion 20A will be pulled loose further and further, as shown in FIG. 4C, until the weakening line 23 is completely broken. In the meanwhile, the film material 2 is moved by the cords 32, at speed $v_1$, so that a new cushion 20B comes between the circulating elements 35, ready to be separated by the second pair of circulating cams 40.

The circulating speed of the circulating elements 35 is preferably geared to the conveying speed $v_1$ of the conveying means 30 and the dimension of the cushions 20 (measured between successive weakening lines 23) such that the cams 40 engage a cushion 20 to be separated at a short distance from the weakening line 23 to be broken (as can clearly be seen in FIG. 4B). Thus, the most effective tensile force can be exerted on the respective weakening line 23 and tensile forces on the cushion itself are minimized. This helps to prevent damage of the cushion.

It goes without saying that, in an alternative embodiment, the circulating elements 35 may comprise only one carrying cam 40 or comprise more than two carrying cams 40, while the circulating speed may be adjusted accordingly, in order to make the point of application of the cams 40 occur near a weakening line 23.

Further, with the separating apparatus 10, string of multiple cushions 20 may be separated. To this end, the circulating elements 35 may be stopped temporarily, so that none of the cams 40 is in engagement with the film material 2 until the desired number of cushions has passed. The counting of these cushions may take place automatically, with the aid of detection means known per se, such as a photocell or a counting wheel. Such detection means may also be used to accurately control the circulating speed of circulating elements, so that the carrying cams 40 always engage the film material at a desired moment.

The carrying cams 40 may be formed integrally with the belts 36, as local thickenings, or as separate elements, for instance plastic blocks, which may be fixedly connected with the belts 36. The cams 40 are preferably provided with an antiskid surface, in order to increase their grip on the film material 2.

As can be seen in FIGS. 1 and 2, the filling and sealing apparatus 5 and the separating apparatus are placed one below the other, next to the supply provision 3. Thus, a very compact arrangement can be obtained. The film material 2 can be guided obliquely upwards from the supply provision 3 and be guided substantially vertically downwards via a diversion rod 42, to the filling and sealing apparatus 5 and the separating apparatus 10. As can be seen in the side elevational view of FIG. 2, the filling and sealing apparatus 5 inclines slightly forward with respect to the separating apparatus 10. As a result, the conveying direction A of the film material 2 when passing through the filling and sealing apparatus 5 includes an angle $\alpha$ with the conveying direction B when passing through the separating apparatus 10. It has been found that such a bend in the conveying direction adequately fits to a 'natural' path that the film material 2 wants to follow during passing through the assembly 1.

Figure 5A:
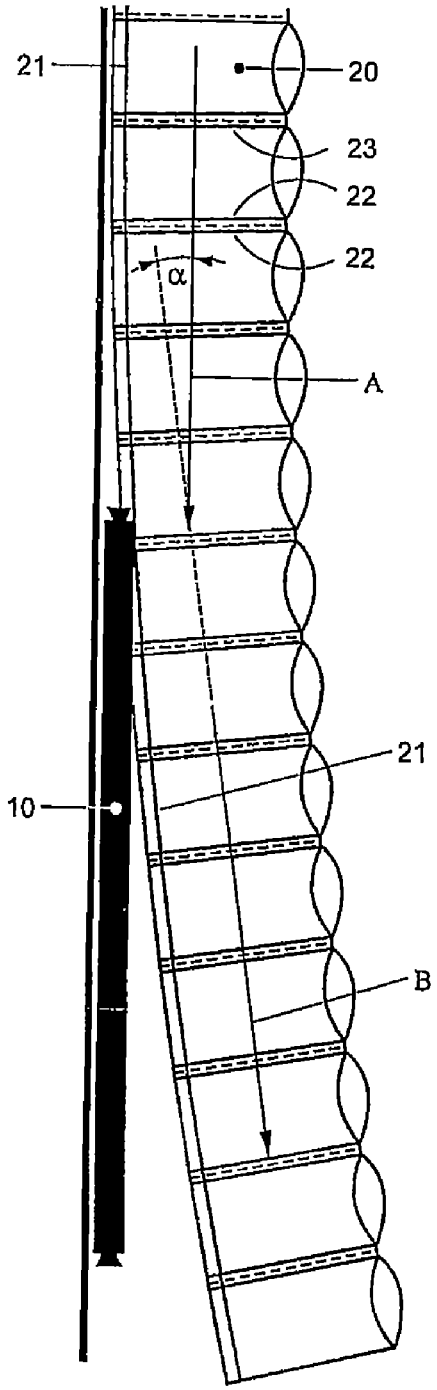
FIGS. 5A,B schematically show the assembly according to FIG. 2, without and with bend in the feed-through direction, respectively.

This is schematically illustrated in FIG. 5A. In this Figure, it can be seen how, during filling, the chambers 20 can bulge more on their free side remote from the filling apparatus 5 than on their clamped side. As a result, the free side will shorten more than the clamped side and the string of film material 2 will tend to become warped.

If this is not taken into account, there is a risk of the string with filled chambers running out of the separating apparatus 10. In order to prevent this, the clamping force between the conveying cords 32 can be increased. However, this will cause the forces required for the drive of these cords 32 to increase as well, which results in a higher energy consumption and a larger load on parts. In addition, this will cause undesired tensile forces to be exerted on the cushions 20, so that they may, for instance, tear or may be separated from each other prematurely.

Figure 5B:
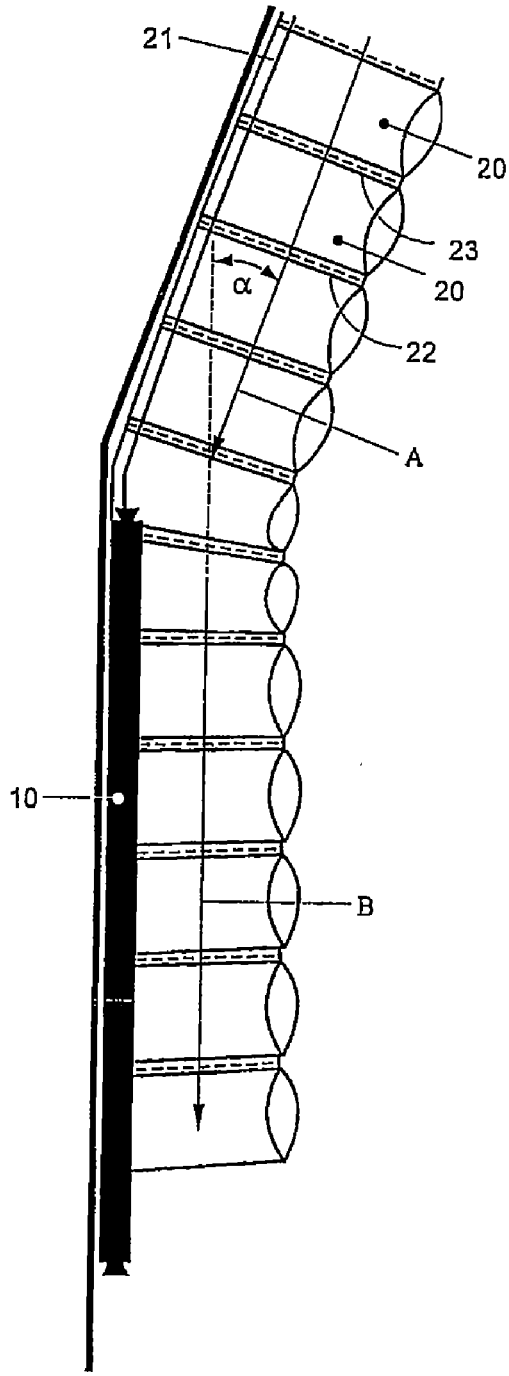

With the embodiment according to FIG. 2, above behavior is taken into account by placing the respective conveying directions A, B of the filling and sealing apparatus 5 and the separating apparatus 10 at an angle $\alpha$ with each other, this angle $\alpha$ preferably corresponding as well as possible with the natural angle of curvature $\alpha$ of the string, as shown in FIG. 5B.

Figure 6A:
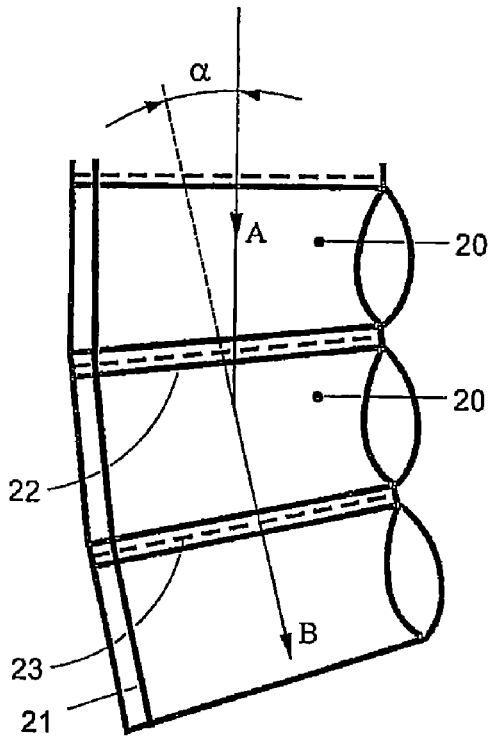
FIGS. 6A,B schematically show the influence of the cushion dimensions on the curve in the path of travel of the cushions, after they have been filled.
Figure 6B:
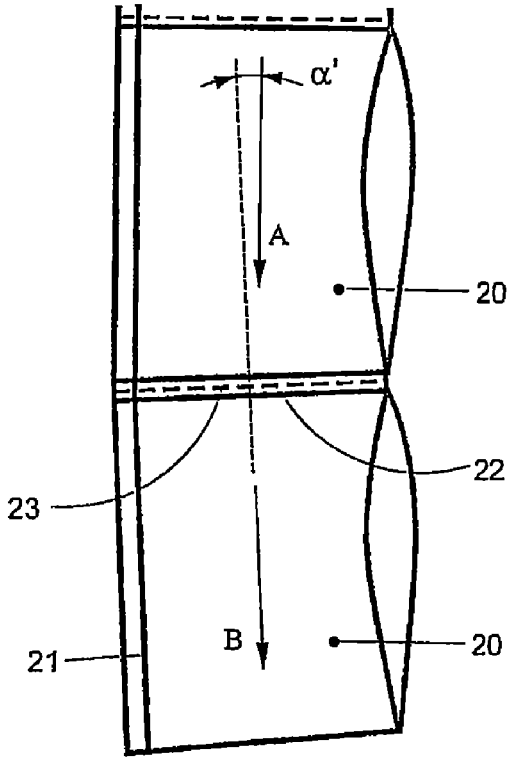

In the exemplary embodiment shown, the angle $\alpha$ is about 30°. In alternative embodiments, this angle $\alpha$ may of course be chosen to be larger or smaller, depending on the anticipated warping behavior of the chambers 20 to be filled. This warping behavior inter alia depends on the degree of filling and the dimensions of the chambers 20 to be filled, in particular the width thereof, measured between successive cross sealing seams 22. This is shown in FIGS. 6A,B, which clearly show that the angle of curvature $\alpha$ is larger as the chambers 20 have a smaller width (which can simply be attributed to the afore-described bulging effect).

The invention is by no means limited to the exemplary embodiments shown in the description and the drawing. All combinations of (parts of) embodiments described and/or shown are understood to fall within the inventive concept. In addition, many variations thereof are possible within the framework of the invention set forth in the claims.

Thus, the separating apparatus may be equipped with only one circulating element. In that case, the other circulating element may be replaced by a stationary counter block, along which the film material is moved with the aid of the one circulating element. Alternatively, the circulating elements may comprise a driven pressure roller, which may intermittently be brought into and out of contact with the passing film, with the pressure roller being driven at a higher speed than the conveying speed of the film material.

These and many variations are understood to be within the framework of the invention as set forth in the following claims.

The invention claimed is:

1. A separating apparatus for separating interconnected cushions, by breaking weakening lines provided between the interconnected cushions, wherein the separating apparatus comprises:

at least one circulating element; and a conveyor for carrying the interconnected cushions along the circulating element, and wherein the circulating element is arranged for engaging the interconnected cushions at least once during a circulating movement, thereby carrying the engaged cushion along over a part of the circulating movement at a carrying speed which is higher than a conveying speed of the conveyor, wherein a carrying direction of the circulating element substantially corresponds with a conveying direction of the conveyor, wherein the circulating element comprises an endless belt guided around one or more rollers, the circulating element comprising at least one carrying cam, the carrying cam extending away from a belt surface, of the endless belt, facing said rollers, and the carrying cam being integrally formed with the endless belt to temporarily engage a cushion to be separated during a circulating movement of the endless belt, and wherein integrally forming the carrying cam with the endless belt is provided by at least one of the set of physical endless belt configurations consisting of:

a local thickening of a belt material of the endless belt, and a separate cam element that is fixedly connected with the endless belt.

2. A separating apparatus according to claim 1, wherein the apparatus comprises two circulating elements, driven in opposite directions, between which the interconnected cushions can be carried along.

3. A separating apparatus according to claim 2, wherein the conveyor comprises at least one endless belt, arranged for carrying along a longitudinal edge of the interconnected cushions.

4. A separating apparatus according to claim 3, wherein the conveyor and the at least one circulating element are driven by common drive means.

5. A separating apparatus according to claim 4, wherein the circulating element is arranged for engaging a longitudinal edge of the interconnected cushions.

6. A separating apparatus according to claim 1 wherein the endless belt is arranged lengthwise inside the path of travel of the conveyor.

7. A separating apparatus according to claim 1 wherein the at least one circulating element comprises first and second instances of the circulating element, and wherein each circulating element comprises a circulating belt provided with a carrying cam, and wherein during use the carrying cam for the first and second circulating elements come into engagement with the cushion to be separated.

8. An assembly of a separating apparatus comprising:

a separating apparatus for separating interconnected cushions, by breaking weakening lines provided between the interconnected cushions, wherein the separating apparatus comprises:

at least one circulating element; and a conveyor for carrying the interconnected cushions along the circulating element, and wherein the circulating element is arranged for engaging the interconnected cushions at least once during a circulating movement, thereby carrying the engaged cushion along over a part of the circulating movement at a carrying speed which is higher than a conveying speed of the conveyor, wherein a carrying direction of the circulating element substantially corresponds with a conveying direction of the conveyor, wherein the circulating element comprises an endless belt guided around one or more rollers, the circulating element comprising at least one carrying cam, the carrying cam extending away from a belt surface, of the endless belt, facing said rollers, and the carrying cam being integrally formed with the endless belt to temporarily engage a cushion to be separated during a circulating movement of the endless belt, and wherein integrally forming the carrying cam with the endless belt is provided by at least one of the set of physical endless belt configurations consisting of:

a local thickening of a belt material of the endless belt, and a separate cam element that is fixedly connected with the endless belt; and an apparatus for inflating and sealing chambers formed in film material, wherein a main feed-through direction along these apparatuses bends where the chambers are inflated or at a short distance thereof.

9. An assembly according to claim 8, wherein a feed-through direction of the separating apparatus includes an angle ($\alpha$) with a feed-through direction of the apparatus for inflating and sealing the chambers, wherein this angle $\alpha$ is between 25° and about 45°.

10. An assembly according to claim 9, wherein a feed-through direction of the separating apparatus operatively extends approximately vertically.

11. An assembly according to claim 10, wherein the separating apparatus is designed as an autonomous module.

12. An assembly according to claim 11, wherein the conveyor of the separating apparatus and a conveyor of the apparatus for inflating and sealing the chambers use common drive means.

13. An assembly according to claim 12, wherein the separating apparatus and the apparatus for inflating and sealing the chambers comprise a common conveyor.

14. An assembly according to claim 9, wherein the angle ($\alpha$) is about 30°.

* * * * *